US009410470B2

(12) United States Patent
Wegener et al.

(10) Patent No.: US 9,410,470 B2
(45) Date of Patent: Aug. 9, 2016

(54) EXHAUST MANIFOLD

(71) Applicant: Benteler Automobiltechnik GmbH, Paderborn (DE)

(72) Inventors: Mario Wegener, Borgentreich (DE); Elmar Grussmann, Altenbeke-Buke (DE); Uwe Fischer, Bad Arolsen (DE); Tobias Gockel, Meschede (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 0 days.

(21) Appl. No.: 14/691,102

(22) Filed: Apr. 20, 2015

(65) Prior Publication Data

US 2015/0300235 A1 Oct. 22, 2015

(30) Foreign Application Priority Data

Apr. 22, 2014 (DE) ..... 10 2014 105 656

(51) Int. Cl.

*F01N 13/10* (2010.01)
*F01N 13/18* (2010.01)
*F01N 13/14* (2010.01)

(52) U.S. Cl.

CPC ..... *F01N 13/1816* (2013.01); *F01N 13/102* (2013.01); *F01N 13/105* (2013.01); *F01N 13/1811* (2013.01); *F01N 13/1827* (2013.01); *F01N 13/1844* (2013.01); *F01N 13/1872* (2013.01); *F01N 13/1888* (2013.01); *F01N 13/141* (2013.01); *F01N 2260/10* (2013.01); *F01N 2260/20* (2013.01); *F01N 2450/22* (2013.01); *F01N 2530/04* (2013.01)

(58) Field of Classification Search

CPC ... F01N 13/102; F01N 13/105; F01N 13/141; F01N 13/1888; F01N 2260/20
USPC ..... 60/323, 324
See application file for complete search history.

(56) References Cited

U.S. PATENT DOCUMENTS 4,537,027 A * 8/1985 Harwood ..... F01N 13/10 29/428
4,850,189 A * 7/1989 Arthur ..... F01N 13/10 60/313
5,729,975 A 3/1998 Bekkering (Continued)

FOREIGN PATENT DOCUMENTS

DE 101 02 637 7/2002
DE 103 59 062 7/2005

(Continued)

*Primary Examiner* — Jorge Leon, Jr.
(74) *Attorney, Agent, or Firm* — Henry M. Feiereisen LLC.

(57) ABSTRACT

An exhaust manifold for installation onto a cylinder head of an internal combustion engine includes a housing having plural inlet openings and an outlet opening. The housing includes an inner shell and an outer shell in surrounding relationship to the inner shell to define a gap there between. The inner shell is floatingly arranged in the outer shell and rests at a side of the cylinder head upon a guide plate which is formed with the plural inlet openings and includes guide members respectively arranged about a circumference of the inlet openings. The outer shell has a cylinder-head-proximal marginal region formed with an outwardly bent flange that rests upon the guide plate and is joined in gastight manner to the guide plate by a material joint. The flange has an outer side in opposition to the guide plate, with a collar being arranged on the outer side of the flange.

12 Claims, 2 Drawing Sheets

(56) References Cited

U.S. PATENT DOCUMENTS

| | | | | |
|---|---|---|---|---|
| 5,916,137 | A * | 6/1999 | Hayashi | F01N 13/008 60/323 |
| 6,789,386 | B1 * | 9/2004 | Haerle | F01N 3/2842 277/591 |
| 7,198,459 | B2 | 4/2007 | Grussmann et al. | |
| 8,312,721 | B2 | 11/2012 | Smatloch et al. | |
| 8,382,429 | B2 | 2/2013 | Grussmann et al. | |
| 8,549,851 | B2 | 10/2013 | Grussmann et al. | |
| 8,628,296 | B2 | 1/2014 | Grussmann et al. | |
| 8,726,655 | B2 | 5/2014 | Smatloch et al. | |
| 2005/0097886 | A1 * | 5/2005 | Geminn | F01N 13/102 60/323 |
| 2005/0133012 | A1 | 6/2005 | Grussmann et al. | |
| 2010/0098533 | A1 | 4/2010 | Grussmann et al. | |
| 2011/0131985 | A1 | 6/2011 | Smatloch et al. | |
| 2011/0236191 | A1 | 9/2011 | Grussmann et al. | |
| 2011/0286837 | A1 | 11/2011 | Smatloch et al. | |
| 2011/0308238 | A1 | 12/2011 | Grussmann et al. | |
| 2012/0023928 | A1 | 2/2012 | Smatloch et al. | |
| 2012/0102737 | A1 | 5/2012 | Smatloch et al. | |
| 2012/0104224 | A1 | 5/2012 | Ewers et al. | |
| 2012/0294709 | A1 | 11/2012 | Grussmann et al. | |
| 2013/0064655 | A1 | 3/2013 | Smatloch et al. | |
| 2013/0064656 | A1 | 3/2013 | Smatloch et al. | |

FOREIGN PATENT DOCUMENTS

| | | |
|---|---|---|
| DE | 103 59 073 | 7/2005 |
| EP | 1 206 631 | 2/2005 |
| EP | 1 389 267 | 3/2006 |
| EP | 2 207 950 | 5/2011 |

* cited by examiner

EXHAUST MANIFOLD

CROSS-REFERENCES TO RELATED APPLICATIONS

This application claims the priority of German Patent Application, Serial No. 10 2014 105 656.6, filed Apr. 22, 2014, pursuant to 35 U.S.C. 119(a)-(d), the disclosure of which is incorporated herein by reference in its entirety as if fully set forth herein.

BACKGROUND OF THE INVENTION

The present invention relates to an exhaust manifold.

The following discussion of related art is provided to assist the reader in understanding the advantages of the invention, and is not to be construed as an admission that this related art is prior art to this invention.

An exhaust manifold represents a component of an exhaust system of internal combustion engines, in particular of combustion engines in motor vehicles. When mounted directly onto the cylinder head of the combustion engine, the exhaust manifold assumes the task to collect exhaust gas exiting the individual cylinders and to feed it to the exhaust outlet. Therefore, an exhaust manifold is oftentimes also referred to as exhaust collector.

Heretofore, the automobile industry is faced with the problem to reconcile a demand for compactness and simplicity of exhaust manifolds while still meeting the challenges to cope with the substantial temperature stress to which components of an exhaust manifold are exposed. Thus, the service life of conventional exhaust manifolds is inadequate to date.

It would therefore be desirable and advantageous to provide an improved exhaust manifold to obviate prior art shortcomings.

SUMMARY OF THE INVENTION

According to one aspect of the present invention, an exhaust manifold for installation onto a cylinder head of an internal combustion engine includes a housing having plural inlet openings and an outlet opening, with the housing having an inner shell and an outer shell in surrounding relationship to the inner shell to define a gap there between, with the inner shell being floatingly arranged in the outer shell, a guide plate upon which the inner shell rests at a side of the cylinder head, the guide plate configured to form the plural inlet openings and including guide members respectively arranged at least about part of a circumference of the inlet openings, wherein the outer shell has a cylinder-head-proximal marginal region formed with an outwardly bent flange configured to rest upon the guide plate and joined in a gastight manner to the guide plate by a material joint, with the flange having an outer side in opposition to the guide plate, and a collar arranged on the outer side of the flange.

In accordance with the invention, the inlet openings of the housing correspond with cylinder outlets of the cylinder head of the internal combustion engine. The inlet openings are formed hereby in the guide plate which is associated with the cylinder-head-proximal side of the inner shell. The gap between the inner and outer shells may represent a pure air gap or may be filled with insulation material, such as an insulating mat.

The guide members, arranged at least in part about the circumference of the inlet openings, are configured to deflect or conduct exhaust gas through the inner shell at little flow resistance. As a result of the targeted exhaust-gas conduction, the resistance pressure by the exhaust gas is reduced. The exhaust flow coming from the cylinder head is directed into the inner shell, deflected there and fed jointly to the outlet opening.

The outer shell is able to rest upon the guide plate via the outwardly bent flange and joined gastight to the guide plate by a material joint. The collar arranged on the guide-plate-confronting outer side of the flange is guided externally across and about the outer shell and embraces the outer shell. The collar bears upon the flange, in particular all-round and flatly, and can have a thickness which is greater than a thickness of the guide plate and also of the flange of the outer shell together. Advantageously, the collar can have a wall thickness which is greater than a wall thickness of the guide plate and the flange of the outer shell. By way of example, the guide plate can have a wall thickness of 1.2 mm to 1.5 mm. The inner shell can have a wall thickness of up to 2.0 mm, in particular up to 1.5 mm. The outer shell can have a wall thickness of up to 1.5 mm to 2.0 mm. The flange of the outer shell may also have a thickness of 1.5 mm to 2.0 mm. The collar can have a wall thickness of 5 mm and thus is thicker than the flange of the outer shell and the guide plate together.

Tightness of the housing of the exhaust manifold on the side of the cylinder head is realized by the joint between the guide plate and the outer shell which are joined together by a material joint in a gastight manner. Advantageously, the flange of the outer shell and the guide plate are welded together. The collar is arranged on the outer side and can be loosely placed thereon and secured by fasteners. Of course, it is also conceivable to secure the collar on the outer side of the flange, e.g. by welding.

The inner shell in its entirety is floatingly arranged in the outer shell. The inner shell bears upon the guide plate on the side of the cylinder head.

According to another advantageous feature of the present invention, the collar can extend about the flange in one piece. As a result, the collar assumes a ring-shaped configuration and is guided via its opening across the outer shell of the housing and rests upon the outer side of the flange.

According to another advantageous feature of the present invention, the collar, the flange and the guide plate can have complementing mounting holes. Using suitable fasteners, e.g. screw fasteners, which are guided through the mounting holes, the exhaust manifold can be threadably attached to the cylinder head of an internal combustion engine. Optionally, a seal may be placed between the guide plate and the cylinder head of the internal combustion engine.

According to another advantageous feature of the present invention, an insulation material can be received in the gap between the inner shell and the outer shell. In particular, the insulation material involves a fiber material. Advantageously, the insulation material may be a pre-formed, shell-shaped insulation mat pressed between the inner and outer shells. The insulation mat assumes the task of a spring or spring unit and presses the inner shell against the guide plate. The insulation mat, in turn, is supported on the outer shell.

According to another advantageous feature of the present invention, the guide members can be formed in one piece from the guide plate so as to be of a same material. Advantageously, the formation of the guide members can be realized during production of the inlet openings. The guide members are hereby formed in a manner of an eyelet from the guide plate.

According to another advantageous feature of the present invention, the outer shell can have an outlet neck, and an outlet flange can be joined by a material joint, e.g. welded, with the outlet neck in a gastight manner. The exhaust manifold can thus be connected via the outlet flange to downstream components of the exhaust system, such as for example a turbocharger or housing of a turbocharger or an exhaust pipe.

According to another advantageous feature of the present invention, the inner shell can have an outlet neck sized to, at least in part, project into the outlet neck of the outer shell. Advantageously, the outlet neck of the inner shell bears with its length portion, which projects into the outlet neck of the outer shell, on the inside of the outlet neck of the outer shell. An embodiment is, of course, also conceivable in which the outlet neck of the inner shell does not rest inside of the outlet neck of the outer shell.

The outlet neck of the inner shell is also freely movable in the outlet neck of the outer shell. The insulation material arranged between the inner and outer shells maintains hereby the inner shell in place. Any changes in length or shape as a result of encountered operating temperatures or changes in temperatures are compensated in the system.

An exhaust manifold according to the invention thus is simple in structure, compact, and yet reliable in operation, and can be installed in an efficient manner. The exhaust manifold can be mounted to the cylinder head of the combustion engine by a mounting system, formed by the outer marginal region of the guide plate, the flange of the outer shell, and the collar. The collar represents the essential component of the necessary mass for a stable assembly of the exhaust manifold onto the cylinder head. Tightness of the system is ensured in a reliable and simple way, without the need for complex seals between the housing and the guide plate. Moreover, an exhaust manifold according to the present invention can be built overall of reduced weight and thin-walled so that the thermal mass and thus the response behavior of a downstream catalytic converter can be improved after a cold start. In addition, air-gap insulated exhaust manifolds in accordance with the invention have the advantage that the insulating effect of the air gap reduces heat loss of the exhaust as it flows to the catalytic converter so that the catalytic converter can be quickly heated up and the operating temperature of the catalytic converter is rapidly realized after a cold start. Service life of an exhaust manifold according to the present invention is overall prolonged.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
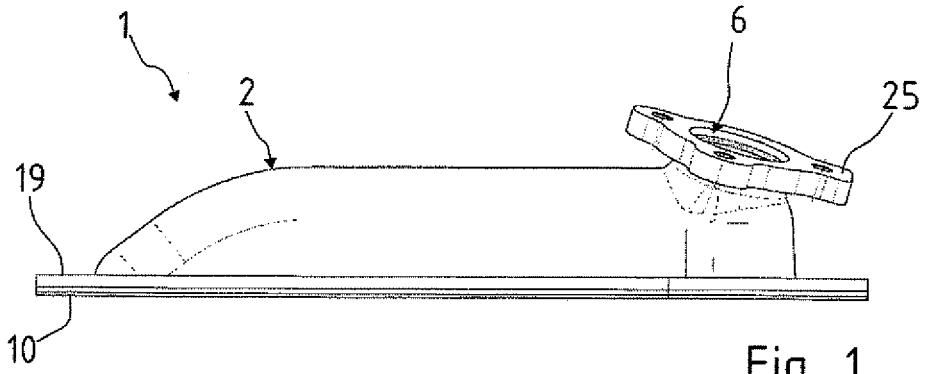
FIG. 1 is a side view of an exhaust manifold according to the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details Which are not necessary for an understanding of the present invention or which render other details difficult to perceive may have been omitted.

Figure 2:
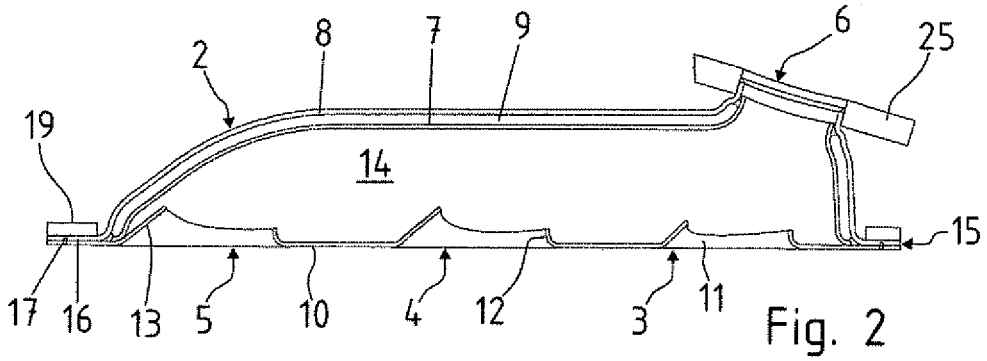
FIG. 2 is a longitudinal section of the exhaust manifold of FIG. 1.
Figure 6:
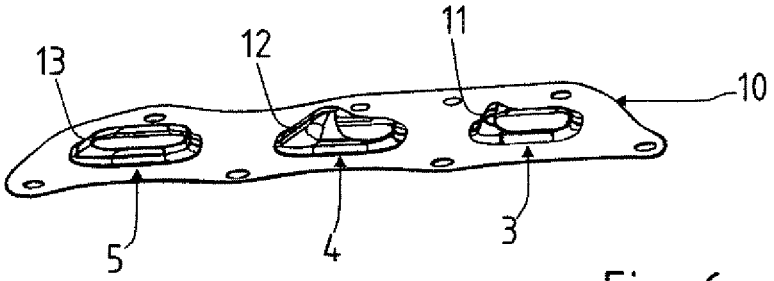
FIG. 6 is a perspective view of a guide plate of an exhaust manifold.

Turning now to the drawing, and in particular to FIG. 1, there is shown a side view of an exhaust manifold according to the present invention, generally designated by reference numeral 1, for an exhaust system of a combustion engine. The exhaust manifold 1, e.g. an air gap insulated exhaust manifold, is intended for attachment to a not shown cylinder head of a combustion engine in a motor vehicle, and includes a housing 2 having plural inlet openings 3, 4, 5 and an outlet opening 6. The housing 2 includes an inner shell 7 and an outer shell 8. The outer shell 8 surrounds the inner shell 7, thereby forming a gap 9 there between. A guide plate 10 is arranged on a cylinder-head-proximal side of the inner shell 7. The guide plate 10 is configured to have the inlet openings 3, 4, 5, with guide members 11, 12, 13 being respectively formed about the circumference of the inlet openings 3, 4, 5. The guide members 11, 12, 13 are hereby configured as projections which are formed from the guide plate 10 and project inwardly into the housing 2 (FIG. 6). The guide members 11, 12, 13 collect or unite exhausts, incoming from the cylinder outlets via the inlet openings 3, 4, 5, in an interior space 14 (FIG. 2) of the inner shell 7 and direct the exhaust flow in a direction of the outlet opening 6.

The outer shell 8 has a cylinder-head-proximal marginal region 15 which is formed with an outwardly bent circumferential flange 16. The flange 16 rests upon the guide plate 10 and is joined with the guide plate 10 circumferentially by a material joint in the form of a weld seam 17 in a gastight manner. Advantageously, the joint is realized thermally by laser welding.

The flange 16 has an outer side 18 in opposition to the guide plate 10. A collar 19 is arranged on the outer side 18 of the flange 16 and extends in one piece as a closed member along the flange 16 about the outer shell 8. The collar 19 may be fixed upon the flange 16, in particular by welding. Also conceivable is the provision of a continuous circumferential weld between the collar 19 and the flange 16.

Figure 3:
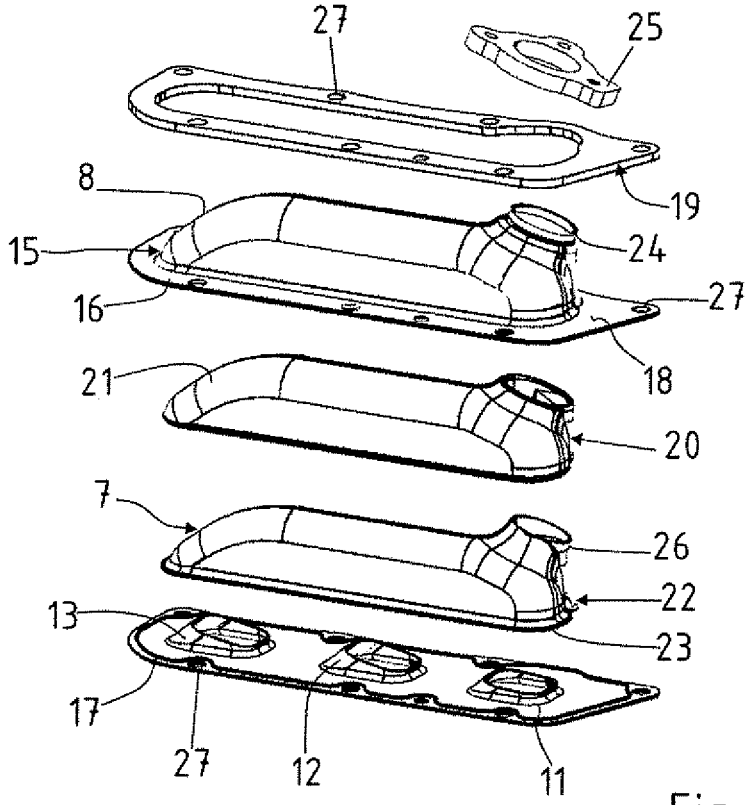
FIG. 3 is an exploded illustration of the components of the exhaust manifold.
Figure 7:
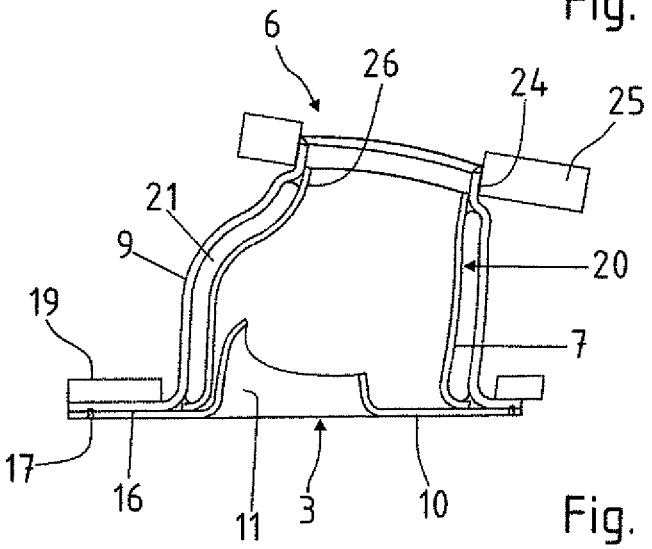
FIG. 7 is a cross section through the exhaust manifold in the area of an outlet flange.

As shown in particular in FIGS. 3 and 7, an insulation material 20 is placed in the gap 9 between the inner shell 7 and the outer shell 8. The insulation material 20 is configured as a pre-fabricated, shell-shaped insulation mat 21. The insulation mat 21 has a configuration which conforms to an inner contour and outer contour of the outer shell 8 and the inner shell 7, respectively. The insulation material 20 has both sound attenuating and thermally insulating properties, The guide members 11, 12, 13 are made of a same material in one piece from the guide plate 10. As a result of the contour of the guide members 11, 12, 13, the inlet openings 3, 4, 5 taper from the guide plate 10 toward the end of the guide members 11, 12, 13. This has a positive effect on flow conditions in the inner shell 7 and the directed exhaust flow during deflection from the inlet openings 3, 4, 5 to the outlet opening 6.

Figure 4:
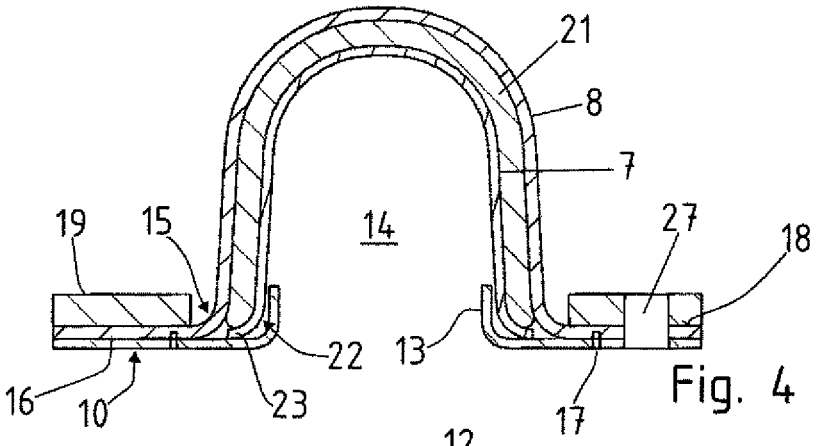
FIG. 4 is a cross section of the exhaust manifold.

As is readily apparent from FIG. 4, the inner shell 7 has a cylinder-head-proximal marginal region 22 which is formed with an outwardly bent collar 23. The inner shell 7 is placed via the collar 23 upon the guide plate 10. This is also readily apparent in FIG. 7. As is further shown, the guide members 11, 12, 13 project inwards into the inner shell 7. As is further apparent from FIG. 4, the guide member 13 contacts the inner shell 7 on the inside so that the inner shell 7 is oriented in place by the guide member 13.

The outer shell 8 has an outlet neck 24 (FIG. 3). The outlet opening 6 is formed in the outlet neck 24 of the outer shell 8. An outlet flange 25 (FIGS. 1 and 3) is joined by a material joint, e.g. tightly welded, with the outlet neck 24 in a gastight manner. The exhaust manifold 1 can thus be connected via the outlet flange 25 to downstream components of the exhaust system.

As is readily apparent from FIG. 7, also the inner shell 7 has an outlet neck 26. The outlet neck 26 of the inner shell 7 rests upon the inside of the outlet neck 24 of the outer shell 8. The outlet neck 26 of the inner shell 7 rests in particular tightly against the inner circumference of the outlet neck 24 of the outer shell 8, but is still mobile so as to be able to move along the inner circumference.

Figure 5:
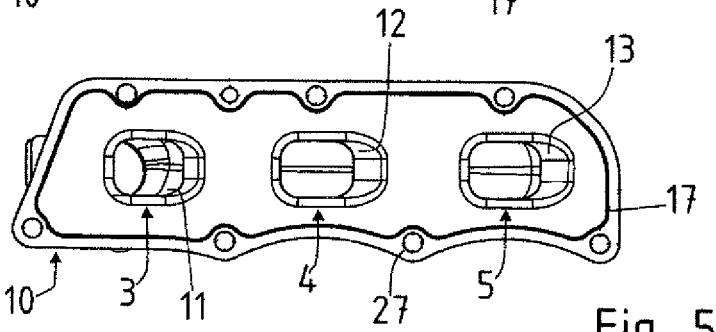
FIG. 5 is a bottom view of the exhaust manifold.

The collar 19, the flange 16, and the guide plate 10 have corresponding mounting holes 27, as shown in FIGS. 3, 4, 5. Fasteners in the form of screw bolts are guided through the mounting holes 27 and threadably engaged in threaded bores in the cylinder head to secure and clamp the exhaust manifold 1 to the cylinder head of an internal combustion engine.

The exhaust manifold 1 is lightweight as a result of its lightweight construction. The outer shell 8 and the guide plate 10 form an outer system which is connected by welding in a gastight manner. By directing and guiding the exhaust flow from the cylinder head into the inner shell 7 via the guide members 11, 12, 13 in the guide plate 10, little resistance pressure is generated and the resistance pressure by the exhaust gas is reduced.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. An exhaust manifold for installation onto a cylinder head of an internal combustion engine, comprising:

a housing having plural inlet openings and, an outlet opening, said housing having an inner shell and an outer shell in surrounding relationship to the inner shell to define a gap there between, with the inner shell being floatingly arranged in the outer shell;

a guide plate upon which the inner shell rests at a side of the cylinder head, said guide plate configured to form the plural inlet openings and including guide members respectively arranged at least about part of a circumference of the inlet openings, wherein the outer shell has a cylinder-head-proximal marginal region formed with an outwardly bent flange configured to rest upon the guide plate and joined in a gastight manner to the guide plate by a material joint, said flange having an outer side in opposition to the guide plate; and a collar arranged on the outer side of the flange such that the flange is sandwiched directly between the collar and the guide plate.

2. The exhaust manifold of claim 1, wherein the flange of the outer shell and the guide plate are welded together.

3. The exhaust manifold of claim 1, wherein the collar is secured to the flange.

4. The exhaust manifold of claim 1, wherein the collar extends about the flange in one piece.

5. The exhaust manifold of claim 1, wherein the collar, the flange and the guide plate have complementing mounting holes.

6. The exhaust manifold of claim 1, further comprising an insulation material received in the gap between the inner shell and the outer shell.

7. The exhaust manifold of claim 1, wherein the guide members are formed in one piece from the guide plate so as to be of same material.

8. The exhaust manifold of claim 1, wherein the outer shell has an outlet neck, and further comprising an outlet flange joined by a material joint with the outlet neck in a gastight manner.

9. The exhaust manifold of claim 8, wherein the inner shell has an outlet neck sized to, at least in part, project into the outlet neck of the outer shell.

10. The exhaust manifold of claim 1, wherein the collar has a thickness which is greater than a thickness of the guide plate and of the flange of the outer shell.

11. The exhaust manifold of claim 1, wherein the flange has a wall thickness which is greater than a wall thickness of the guide plate.

12. The exhaust manifold of claim 1, wherein the guide members are configured such that the inlet openings taper from the guide plate toward an end of the guide members.

* * * * *